US009695768B2

(12) United States Patent
Horst

(10) Patent No.: US 9,695,768 B2
(45) Date of Patent: Jul. 4, 2017

(54) DETERMINATION OF THE EFFECTIVE FUEL-AIR RATIO OF A SUPERCHARGED INTERNAL COMBUSTION ENGINE WITH SCAVENGING AIR COMPONENT

(71) Applicant: GM GLOBAL TECHNOLOGY OPERATIONS LLC, Detroit, MI (US)

(72) Inventor: Stefan Horst, Neu-Isenburg (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 257 days.

(21) Appl. No.: 14/525,028

(22) Filed: Oct. 27, 2014

(65) Prior Publication Data

US 2015/0114374 A1 Apr. 30, 2015

(30) Foreign Application Priority Data

Oct. 25, 2013 (DE) ..... 10 2013 017 799

(51) Int. Cl.
*F02D 13/02* (2006.01)
*F02D 41/14* (2006.01)
*F02D 41/00* (2006.01)

(52) U.S. Cl.
CPC ..... *F02D 41/1475* (2013.01); *F02D 13/0261* (2013.01); *F02D 13/0276* (2013.01);
(Continued)

(58) Field of Classification Search
CPC ..... F02D 41/1448; F02D 41/1475; F02D 41/0085; F02D 41/1454; F02D 41/009;
(Continued)

(56) References Cited

U.S. PATENT DOCUMENTS 6,276,349 B1 8/2001 Kofler et al.
7,562,653 B2 * 7/2009 Zhang ..... F01N 3/28 123/673

(Continued)

FOREIGN PATENT DOCUMENTS

DE 102008040175 A1 1/2010
DE 102009001673 A1 9/2010
EP 2058493 A1 5/2009

OTHER PUBLICATIONS

German Patent Office, German Search Report for German Application No. 102013017799.5, dated Jan. 10, 2014.

(Continued)

*Primary Examiner* — Hai Huynh
*Assistant Examiner* — George Jin
(74) *Attorney, Agent, or Firm* — Lorenz & Kopf LLP

(57) ABSTRACT

A method for the fuel consumption reduction and/or power increase of an internal combustion engine of a motor vehicle is disclosed. A crank angle of a crankshaft is detected at which out of a cylinder the exhaust gases of a cylinder can be representatively measured on a lambda probe. The exhaust gas flow is measured on the lambda probe. A signal of the lambda probe is scanned at the time of the detection of the crank angle. A value indicated the detected angle and/or the scanned signal is sent to a computer. The value is corrected with the help of an exhaust gas pressure or exhaust gas back pressure model stored in the computer. An effective combustion lambda of the cylinder is calculated based on the sent values and a global lambda value stored in the computer and used to the control of the internal combustion engine.

15 Claims, 2 Drawing Sheets

(52) U.S. Cl.
CPC ..... *F02D 41/009* (2013.01); *F02D 41/0085* (2013.01); *F02D 41/1448* (2013.01); *F02D 41/1454* (2013.01); *F02D 41/145* (2013.01); *F02D 2200/0611* (2013.01); *F02D 2200/08* (2013.01); *F02D 2250/14* (2013.01)

(58) Field of Classification Search
CPC .. F02D 41/145; F02D 41/008; F02D 41/1439; F02D 41/30; F02D 41/1443; F02D 2200/08; F02D 2200/14; F02D 2700/0212; F02D 2250/14; F02D 13/0203; F02D 13/0261; F02D 13/0276; G01M 15/106; F01N 11/002
USPC ..... 60/602, 276, 286, 289, 306, 307; 123/672, 673, 676, 703; 73/114.69, 73/114.71, 114.72, 114.73, 114.74, 73/114.75, 114.76
See application file for complete search history.

(56) References Cited

U.S. PATENT DOCUMENTS

2002/0011101 A1* 1/2002 Hartke ..... F01L 9/04 73/114.78
2002/0134081 A1* 9/2002 Shiraishi ..... F01N 3/28 60/602
2004/0134462 A1* 7/2004 Strom ..... F02B 1/12 123/294
2004/0182079 A1* 9/2004 Akao ..... F02D 41/18 60/605.2
2006/0254568 A1* 11/2006 Bornitz ..... F02D 41/008 123/676
2006/0278196 A1 12/2006 Beer et al.
2007/0113827 A1* 5/2007 Moriya ..... F02D 13/0203 123/435
2009/0277434 A1* 11/2009 Surnilla ..... F01L 9/04 123/65 R
2013/0255631 A1 10/2013 Ruhland et al.
2015/0275802 A1* 10/2015 Takamiya ..... F02D 41/1454 60/602

OTHER PUBLICATIONS

Great Britain Patent Office, Great Britain Search Report for Great Britain Application No. 1418249.7, dated Apr. 10, 2015.

* cited by examiner

DETERMINATION OF THE EFFECTIVE FUEL-AIR RATIO OF A SUPERCHARGED INTERNAL COMBUSTION ENGINE WITH SCAVENGING AIR COMPONENT

CROSS REFERENCE TO RELATED APPLICATION

This application claims priority to German Patent Application No. 102013017799.5 filed Oct. 25, 2013, which is incorporated herein by reference in its entirety.

TECHNICAL FIELD

The technical field relates to a method and a device for the fuel reduction and/or power increase of an internal combustion engine, whereby an effective combustion lambda in a cylinder can be calculated and used in an engine control method.

BACKGROUND

The industry attempts to optimize the fuel consumption of motor vehicles as one of numerous measures because of the continuously changing regulation for the emission of pollutants of motor vehicle combustion engines. This means attempts are made among others to optimize the fuel consumption based on the power of the combustion engine.

There is therefore a need for a method and a drive system for a motor vehicle, with which the fuel of an internal combustion engine can be reduced and/or a power increase of the internal combustion engine achieved.

SUMMARY

The present disclosure provides a method for the fuel consumption reduction and/or power increase of an internal combustion engine. The method includes a) detecting a crank angle, at which the exhaust gases of a cylinder combustion can be representatively measured on a lambda probe; b) continuous measuring of an exhaust gas flow on the lambda probe, c) scanning a signal of the lambda probe at the time of the detection of the crank angle, d) sending a value representative of the scanned signal and/or the detected crank angle to a computer, e) correcting the value with an exhaust gas pressure or exhaust gas back pressure model stored in the computer, and f) calculating an effective combustion lambda of the cylinder based on the sent values and a global lambda value stored in the computer.

The crank angle is the angular position of the crankshaft at a certain time. The time in the described method is the time at which out of the combustion engine the exhaust gas of a single cylinder combustion can be representatively measured on the lambda probe by means of a scanner, for example an integrated circuit (IC) or a voltage transducer. The exhaust gas is the combustion product of an air-fuel mixture combusted in the cylinder respectively in a combustion chamber of the cylinder.

In other words, the method commences when the crankshaft has reached the preset known angular position. At that moment, the exhaust gas flow of the cylinder combustion is measured on the lambda probe, respectively a signal of the lambda probe in particular of a pre-turbine probe, is scanned. Alternatively, the method may also be realized with a post-turbine probe.

In the following, the method is described with the help of a device with a pre-turbine probe, without the use of a post-turbine probe being excluded because of this. The restriction to a pre-turbine probe in the description merely serves for better readability. The global lambda value stored in the computer can be represented by an exhaust gas pressure or exhaust gas back pressure model.

The signal of the pre-turbine probe shows the dynamic characteristic of individual cylinder exhaust gas with minor deviation from the actual value, since only a minor mixing-through with the exhaust gas of other cylinders occurs. At the time of the scan, the measured amplitude therefore is near the actual combustion lambda value of the combustion. The combustion lambda is measured through the sequential scan but has a systematic error which can be depicted by a comparison with the model values stored in a memory of the computer.

From the data that is detected, scanned and corrected with the help of the model the computer, following optional filtering of the data, can calculate an effective scavenging air component in the exhaust gas flow, since at the moment, at which the exhaust gas flow is detected on the lambda probe sensor, no or at least almost no scavenging air component is visible in the detected exhaust gas flow. The exhaust gas pressure or exhaust gas back pressure model in the case of which the exhaust gas back pressure is an input quantity in the model, includes a corrective for the lambda probe signal.

The computer can compare the calculated effective combustion lambda of the cylinder with a combustion lambda preset in the model for the detected exhaust gas mass flow and/or the tapped-off pre-turbine probe value. A similar systematic deviation of the combustion lambda is applied into the mentioned model, against which the one with the measurement value is compared. In other words, the exhaust gas pressure or exhaust gas back pressure model can have a correction value for the scanned probe signal. The exhaust gas back pressure may form an input quantity in the model.

If in the process a deviation between the calculated and the modelled combustion lambda is determined, the computer can calculate a correction value in order to bring the calculated effective combustion lambda up to the modelled combustion lambda or render it in accordance with the latter. This means, a correction of the measured cylinder-specific lambda value can be carried out with the help of the values of the model stored in the computer.

Following this, the scavenging air component can be calculated from the current lambda value tapped off on the pre-turbine probe and the global lambda stored in the computer. Following the calculation of the model-based correction and optional filtering the calculation of the actual absolute set point values can take place. Here, individual cylinder deviations are primarily corrected, while secondarily the effective combustion lambda is globally adjusted quantitatively correctly by adapting the injection quantity.

In an embodiment, the scavenging air component can also be corrected instead of the injection quantity in order to correct the measured lambda value, for example through a correction of the crankshaft position. The model may include at least the following input parameters: exhaust gas back pressure (model value via crank angle, engine load); probe ageing coefficient; and ethanol component. The model with these parameters can be constructed via an external, generic model calculation (GD power) and stored in the computer as a characteristic diagram calculation operation.

Downstream of this, a calibration factor is included in the calculation which is obtained from a rotational speed load-dependent correction characteristic diagram. This calibration factor is applied during engine setup. For the quantity of the deviation, a limit value can be preset in the computer which has to be reached or exceeded before the computer calculates a correction value. As a function of the calculated correction value, the computer can generate signals and send these to a control unit.

Because of this, the quantity of a fuel and/or combustion air supply to the cylinder can, for example, be controlled via the computer in order to achieve a reduction of the fuel consumption and/or a power increase of the internal combustion engine. Or the component of the scavenging air in the exhaust gas can be increased in order to, for example, have sufficient oxygen component for re-treatment, e.g., a re-combustion, of the exhaust gas for example in the catalytic converter, which leads to a reduction of pollutants in the exhaust gas discharged into the environment.

In addition to or instead of the quantity of the combustion air supply, its temperature and/or oxygen content can be changed. In the case of the fuel, a fineness of the atomization through an injection system can be regulated instead or additionally to the quantity.

The described method can be carried out one after the other for each of the cylinders respectively for the cylinders jointly igniting in a cycle. Thus, the effective combustion lambda of each individual cylinder or jointly igniting cylinder can be calculated so that upon a complete revolution of the crankshaft the values of all cylinders of the internal combustion engine are detected and synchronized. Because of this, optimization of the combustion of all cylinders of the internal combustion engine can be achieved, which can lead to a reduction of the fuel consumption and/or a power increase of the internal combustion engine in the exhaust gas after the catalytic converter and an improvement of the smooth operation of the engine.

The signals of at least the detector and of the scanner can be transmitted to the computer via cable connections, such as for example as electrical signals via electrical cables or as optical signals via light-conductive cables, or wirelessly via a local network. In the computer unit, at least the signal of the pre-turbine probe scanned by the scanner can be corrected first and thereafter optionally filtered and statistically evaluated.

A further aspect of the present disclosure relates to a drive system for a motor vehicle. The drive system includes an internal combustion engine with a turbocharger, a camshaft for controlling valves for at least one cylinder of the internal combustion engine, a detector, which detects an angle of rotation of a crankshaft of the internal combustion engine, a lambda probe sensor, which continuously detects an exhaust gas flow flowing out of the at least one cylinder on a lambda probe, a scanner, which at any time scans current values of the lambda probe sensor, and a computer, which can be signal-connected to at least the detector and the scanner. The computer includes a memory in which the global lambda values for the internal combustion engine are stored. The computer calculates an effective combustion lambda of the at least one cylinder and/or a scavenging air component in the exhaust gas flow after the at least one cylinder from a detected angle of rotation of the crankshaft and/or a scanned lambda probe signal and the global and/or sequential lambda values.

Here, the detector can detect the angle of rotation of the crankshaft at which the exhaust gas flow of a single combustion flows out of the cylinder. The scanner evaluates the continuous signal of the lambda probe that can be scanned at any time. In particular, the signal is evaluated exactly at the time at which the exhaust gas of a single cylinder combustion is present on the lambda probe or pre-turbine probe. The scavenging air, which normally reaches the exhaust tract through a positive gradient during a valve overlap, is at least not substantially present at this time. The crank angle for the scan is determined by measurement and applied. If the drive system has an internal combustion engine with more than one cylinder, the detector can individually detect and scan one after the other the angle of rotation of the crankshaft and the scanner the lambda probe value for each individual cylinder of the internal combustion engine.

From the detected and scanned values, the computer can calculate an effective combustion lambda and/or in particular globally the scavenging air component or a scavenging air component for each individual cylinder. Here, the calculated values of the combustion lambda can first be compared with the values of an exhaust gas pressure or exhaust gas back pressure model which can be stored in the computer and corrected and filtered when necessary. With these corrected values of the combustion lambda, the actual scavenging air component can then be determined.

With the drive system, a fuel consumption of the internal combustion engine can be reduced and/or a power of the internal combustion engine increased and/or the emission of pollutants by the vehicle simultaneously reduced. In addition, the smooth operation of the internal combustion engine can thereby be improved.

Existing drive systems can be converted in order to achieve the mentioned advantages. For this purpose, any missing detectors or scanners have to be retrofitted and a computer program with the appropriate models and the necessary algorithms uploaded on an existing computer. Here, the scanner for quick sequential scanning of the lambda probe values can be formed for example by an integrated circuit (IC), which is integrated in a control unit for the drive system.

A further aspect relate to a computer program for carrying out the method described above. The computer can include a digital microprocessor unit (CPU) which is data connected to a storage system and a BUS system, a working memory (RAM) and a storage means. The CPU is designed to execute commands which are embodied as a program stored in a storage system, to detect input signals from the data BUS and emit output signals to the data BUS. The storage system can have various storage media such as optical, magnetic, solid and other non-volatile media, on which a corresponding computer program for carrying out the method and the advantageous configurations is stored. The program can be of such a nature that it is capable of embodying or carrying out the methods described here, so that the CPU can carry out the steps of such methods.

Suitable for carrying out a method is a computer program, which includes program code means in order to carry out all steps of the method when the program is executed on a computer. The computer program can be read into already existing control units and used with simple means in order to control a method for the fuel consumption reduction and/power increase of an internal combustion engine of the motor vehicle. The computer program product can also be integrated in control units as a retrofit option.

A further aspect relates to a computer program product which is also described as a computer or machine-readable medium, and which is to be understood as a computer program code on a carrier. Here, the carrier can be of a volatile or non-volatile type with the consequence that this also be referred to as a volatile or non-volatile nature of the computer program product.

An example for a volatile or transitory computer program product is a signal, for example an electromagnetic signal or an optical signal, which is a carrier for the computer program code. The carrying of the computer program code can be achieved by modulating the signal with a conventional modulation method such as QPSK for digital data, so that binary data which represent the computer program code are impressed on the volatile electromagnetic signal. Such signals are utilized for example when a computer program product is transmitted to a laptop without cable via a Wi-Fi connection.

In the case of a non-volatile or non-transitory computer program product, a computer program code is embodied in a substrate-bound storage medium. Then, the storage medium is the abovementioned non-transitory storage medium, so that the computer program code is permanently or non-permanently stored in or on the storage medium. The storage medium can be of a conventional type such as is known in the field of computer technology, for example a flash memory, an ASIC, a CD and the like. The computer program product can also be integrated in control units as a retrofit option.

Throughout the description and the claims the expression "a" is utilized as indefinite article not restricting the number of parts to a single one. Should "a" have the meaning of "only one", such is to be understood from the context to the person skilled in the art or is unambiguously disclosed by the use of suitable expressions such as for example "a single."

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Figure 1:
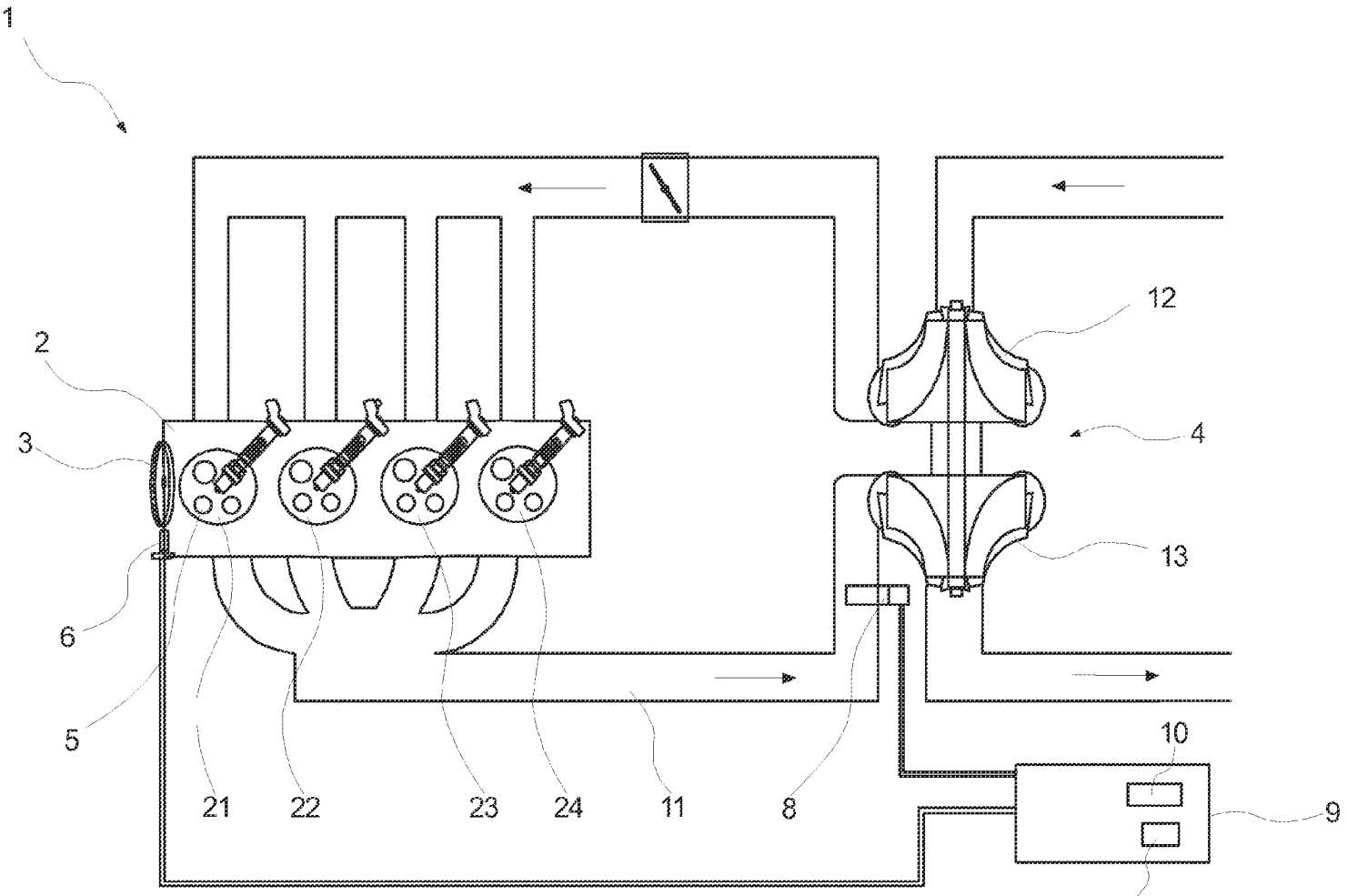
FIG. 1 schematically illustrates a drive system for a motor vehicle with an internal combustion engine having a turbocharger.

A drive system 1 for a motor vehicle is schematically shown in FIG. 1. The drive system 1 includes an internal combustion engine 2 within the exemplary embodiment four cylinders 21, 22, 23, 24. Each of the cylinders 21, 22, 23, 24 has valves 5, which can be opened and closed by a camshaft which is not shown. The internal combustion engine 2 includes a turbocharger 4 with a compressor 12 and a turbine 13. The compressor 12 supplies the internal combustion engine 2 with compressed air for combustion; the exhaust gas flowing out of the cylinders 21, 22, 23, 24 is conducted through the turbine 13 and drives the compressor 12.

On the crankshaft 3, a detector 6 is arranged, which can detect an angle of rotation of the crankshaft 3 and pass it on to a computer 9. With the detector 6, an angle of rotation of the crankshaft 3 and of a crankshaft trigger for controlling the valves 5 for each of the cylinders 21, 22, 23, 24 can be detected for example. Having left the cylinders 21, 22, 23, 24, an exhaust gas flow of a single combustion in one of the cylinders 21, 22, 23, 24 can be measured on a lambda probe 8.

In a line 11, which connects the internal combustion engine 2 to the turbine 13 of the turbocharger 4, a lambda probe 8 is arranged. For rapid sequential scanning of the lambda probe value on the lambda probe 8 at a preset time, a scanner 7 in the form of an integrated circuit is arranged in the computer 9 in the shown exemplary embodiment. The computer 9 includes a memory 10, in which for example global lambda values for the internal combustion engine 2 and/or an exhaust gas pressure or exhaust gas back pressure model of the internal combustion engine 2 are stored.

The detector 6, the lambda probe 8 and the scanner 7 are signal-connected to the computer 9. The computer 8 can process the received data of the detector 6 and of the scanner 7 and from this data calculate an effective combustion lambda for each of the cylinders 21, 22, 23, 24.

In addition, the detector 6 detects an angle of rotation of the crankshaft 3 at which out of only one of the cylinders 21, 22, 23, 24 the exhaust gas flows after the combustion. On the lambda probe 8, the exhaust gas flow is continuously measured and at the moment, at which the detector has detected the corresponding crank angle, the scanner 7 scans the current value on the lambda probe 8.

Since the exhaust gas mass flow at the time of the measurement on the lambda probe 8 is at least substantially free of scavenging air, the computer 9 can with a stored algorithm calculate the effective combustion lambda and/or a scavenging air component in the exhaust gas mass flow for the cylinder 21, 22, 23, 24 from at least one of the values of the detector 6 and/or of the scanner 7 and the global lambda value for the internal combustion engine 2 stored in the memory 10, the exhaust gas mass flow of which has just been measured on the lambda probe 8.

Figure 2:
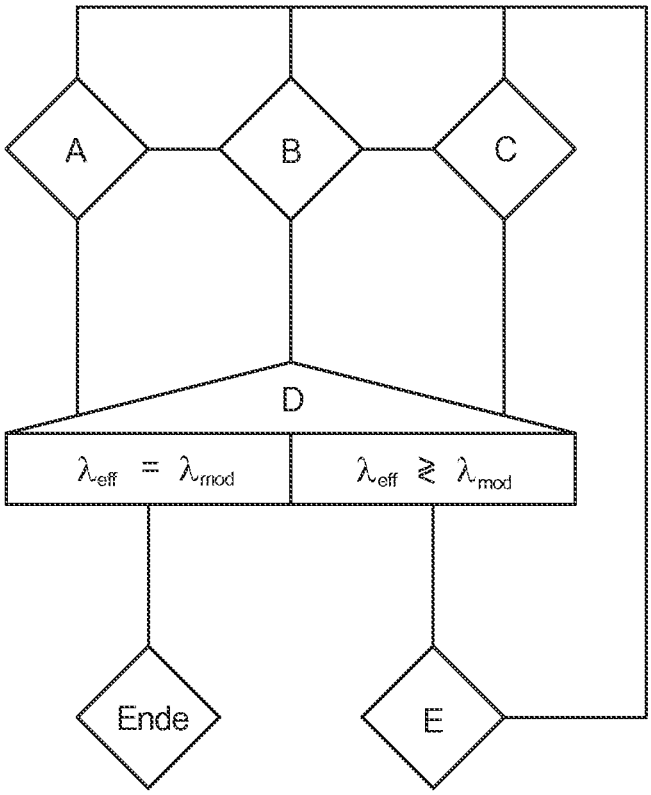
FIG. 2 schematically illustrates a method sequence.

FIG. 2 schematically illustrates a sequence for a method with which a fuel consumption of an internal combustion engine of a motor vehicle can be reduced and/or a power increase of the internal combustion engine can be achieved. The method includes the steps: detecting a crank angle A at which out of a cylinder the exhaust gases of a cylinder combustion are present on a lambda probe, measuring the exhaust gas flow B of the cylinder at the time of the detection of the crank angle and scanning of a signal C of a pre-turbine probe at the time of the detection of the crank angle. Calculating an effective combustion lambda of a cylinder combustion out of the scanned value and a correction value of a default model.

The calculated effective combustion lambda can be compared with a modelled combustion lambda, respectively a set point value of an exhaust gas pressure or exhaust gas backpressure model stored in the computer. If the computer does not determine any deviations of the values or deviations of the values in a permissible limit value range, the method ends and can recommence.

In the case of deviations, the computer can calculate correction values and send control inputs to a control, which can then carry out adjustments E on individual parameters of the drive system. The effectiveness of these adjustments can be verified during the next measurement for the same cylinder.

While at least one exemplary embodiment has been presented in the foregoing detailed description, it should be appreciated that a vast number of variations exist. It should also be appreciated that the exemplary embodiment is only an example, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

The invention claimed is:

1. A method of engine control for fuel consumption reduction or power increase of an internal combustion engine of a motor vehicle, the method comprising:

detecting a crank angle of a crankshaft at which a exhaust gas flow from at least one cylinder can be representatively measured on a lambda probe;

measuring the exhaust gas flow on the lambda probe;

scanning a signal of the lambda probe at the time of the detection of the crank angle to generate a scanned value;

sending the scanned value to a computer;

correcting the scanned value using an model having a global lambda value stored in the computer and representing at least one of an exhaust gas pressure or exhaust gas back pressure;

calculating at least one of an effective combustion lambda of the at least one cylinder and a scavenging air component in the exhaust gas flow after the at least one cylinder a as a function of the scanned value and the global lambda value stored in the computer; and controlling an operating parameter of the internal combustion engine in response to the effective combustion lambda.

2. The method according to claim 1, wherein the exhaust gas flow is measured at the moment of the detection of the crank angle such that no scavenging air flow is visible in the measured exhaust gas flow.

3. The method according to claim 1, further comprising comparing the calculated combustion lambda with a set point value of the combustion lambda of the model.

4. The method according to claim 3, further comprising calculating a correction value from the set point value when a deviation of the effective combustion lambda is determined.

5. The method according to claim 1, wherein at the moment of the scanning of the angle of the crankshaft no scavenging air flow is visible in the scanned signal and the scavenging air flow is calculated by the computer together with the effective combustion lambda out of the measured air mass flow, the global lambda and the scanned lambda probe value.

6. The method according to claim 1 further comprising filtering and statistically evaluating the scanned signal in the computer.

7. The method according to claim 1, wherein controlling an operating parameter of the internal combustion engine comprises send a signal on the basis of the calculated effective combustion lambda from the computer to a control unit for adjusting an air-gas mixture to the cylinders in order to bring about at least one of a fuel consumption reduction and a power increase of the internal combustion engine.

8. The method according to claim 1, wherein controlling an operating parameter of the internal combustion engine comprises send a signal on the basis of a calculated scavenging air flow sends from the computer to a control unit for adjusting an air-gas mixture for the cylinders in order to bring about at least one of a fuel consumption reduction and a power increase of the internal combustion engine.

9. The method according to claim 1, wherein the crank angle is detected by the detector and the lambda probe value for each cylinder of the internal combustion engine is scanned by the scanner, and from these values the effective combustion lambda for each individual cylinder is calculated by the computer.

10. A computer program for carrying out a method according to claim 1.

11. A computer program product comprising program code means stored on a non-transitory computer-readable medium in order to carry out the method according to claim 1 when the program code is executed on the computer.

12. A drive system for a motor vehicle comprising:

an internal combustion engine having a crankshaft, a turbocharger, and a camshaft for controlling valves for at least one cylinder of the internal combustion engine;

a detector configured to detect an angle of rotation of the crankshaft;

a lambda probe sensor configured to continuously detect an exhaust gas flow flowing out of the at least one cylinder;

a scanner configured to scan current values of the lambda probe sensor at any time; and a computer operably coupled to receive signals from the detector and the scanner and having a memory storing global lambda values for the internal combustion engine;

wherein the computer calculates at least one of an effective combustion lambda of the at least one cylinder and a scavenging air component in the exhaust gas flow after the at least one cylinder from at least one of the detected angle of rotation of the crankshaft, a scanned lambda probe signal and the global lambda values and controls an operating parameter of the internal combustion engine in response to the effective combustion lambda.

13. The drive system according to claim 12, wherein the detector detects the angle of rotation of the crankshaft, at which the exhaust gas flow out of the at least one cylinder for a single combustion is present on the lambda probe.

14. The drive system according to claim 13, wherein the scanner scans the lambda probe value at the time of the detection of the angle of rotation of the crankshaft.

15. The drive system according to claim 13, wherein the detector detects the angle of rotation of the crankshaft and the scanner individually scans the lambda probe value for each cylinder of the internal combustion engine, and wherein the computer calculates at least one of an effective combustion lambda and a scavenging air component for each of the cylinders.

* * * * *